US011066230B2

(12) United States Patent
Waugh

(10) Patent No.: US 11,066,230 B2
(45) Date of Patent: Jul. 20, 2021

(54) AEROSOL APPLICATOR OF EXPANDING FOAM CHEMICALS

(71) Applicant: Nathaniel L. Waugh, Piney Flats, TN (US)

(72) Inventor: Nathaniel L. Waugh, Piney Flats, TN (US)

(73) Assignee: Nathaniel L. Waugh, Elizabethton, TN (US)

( * ) Notice: Subject to any disclaimer, the term of this patent is extended or adjusted under 35 U.S.C. 154(b) by 155 days.

(21) Appl. No.: 16/216,003

(22) Filed: Dec. 11, 2018

(65) Prior Publication Data

US 2019/0177074 A1 Jun. 13, 2019

Related U.S. Application Data

(60) Provisional application No. 62/597,188, filed on Dec. 11, 2017.

(51) Int. Cl.

| | |
|---|---|
| ***B65D 83/30*** | (2006.01) |
| ***B65D 83/68*** | (2006.01) |
| ***B65D 83/20*** | (2006.01) |
| ***B05B 7/08*** | (2006.01) |
| *B65D 83/28* | (2006.01) |
| *B65D 83/14* | (2006.01) |

(52) U.S. Cl.

CPC ..... *B65D 83/202* (2013.01); *B05B 7/0884* (2013.01); *B65D 83/303* (2013.01); *B65D 83/68* (2013.01); *B05B 7/08* (2013.01); *B65D 83/28* (2013.01); *B65D 83/753* (2013.01)

(58) Field of Classification Search

CPC ..... B65D 83/28; B65D 83/68; B65D 83/202; B65D 83/303; B65D 83/753; B65D 83/30; B05B 7/0884; B05B 7/08; B05B 7/0433; B05B 7/0441; B05B 7/066; B05B 11/0086; B05B 11/06; B05B 11/3057

USPC ..... 239/433; 222/344, 402.1

See application file for complete search history.

(56) References Cited

U.S. PATENT DOCUMENTS

| | | | | |
|---|---|---|---|---|
| 2,612,403 A * | 9/1952 | Burch | A01C 23/042 | 239/318 |
| 2,887,272 A * | 5/1959 | Rosenthal | B65D 83/207 | 239/310 |
| 4,630,774 A * | 12/1986 | Rehman | B05B 7/0815 | 239/432 |
| 5,078,323 A * | 1/1992 | Frank | B05B 7/1209 | 239/296 |

(Continued)

OTHER PUBLICATIONS

"Introducing the New Great Stuff™ Smart Dispenser™", 2019, Retrieved from the Internet: <www.greatstuff.dupont.com>.

(Continued)

*Primary Examiner* — Joseph A Greenlund

(57) ABSTRACT

A manually operated applicator for spraying and dispensing expanding foam chemicals from aerosol containers is provided. The applicator dispenses compressed gas in close proximity to the foam as the foam exits the applicator, which results in improved adhesion of the foam to surfaces. The applicator includes a nozzle, an aerosol inlet for connection to an aerosol container, a gas inlet for connection to a source of compressed gas, and a trigger for operation of the applicator. The nozzle includes outlets for dispensing the foam and the compressed gas.

8 Claims, 8 Drawing Sheets

(56) References Cited

U.S. PATENT DOCUMENTS 5,292,038 A * 3/1994 Seney ..... B67D 1/0456 222/402.13
5,450,983 A * 9/1995 Stern ..... B05B 1/02 222/1
5,549,246 A 8/1996 Kukesh
5,615,804 A * 4/1997 Brown ..... B05B 1/3046 222/136
5,881,955 A * 3/1999 Styne ..... B05B 7/2443 239/310
5,887,756 A * 3/1999 Brown ..... B29B 7/7409 222/136
6,347,752 B1 * 2/2002 Davidson ..... B05B 7/1209 239/600
8,864,051 B2 * 10/2014 Lin ..... B05B 15/33 239/240
9,808,816 B1 * 11/2017 Enriquez ..... B65D 83/207
10,329,078 B1 * 6/2019 Alonso ..... B65D 83/207
10,351,335 B1 * 7/2019 Alonso ..... B65D 83/388
10,464,736 B1 * 11/2019 Pindor ..... B65D 83/303
10,654,055 B1 * 5/2020 Alonso ..... B05B 7/066
2002/0179737 A1 * 12/2002 Ryser ..... B05B 7/12 239/418
2003/0146298 A1 * 8/2003 Jou ..... B05B 7/2435 239/302
2004/0056124 A1 * 3/2004 Haruch ..... B05B 7/0815 239/690
2005/0284957 A1 * 12/2005 Haruch ..... B05B 7/066 239/290
2009/0014552 A1 * 1/2009 Hines ..... B65D 83/202 239/120
2011/0253806 A1 10/2011 Brem
2013/0264400 A1 10/2013 Crandley
2014/0196918 A1 7/2014 Effenberger et al.
2016/0223097 A1 * 8/2016 Demey ..... F16K 27/065
2016/0279652 A1 * 9/2016 States, III ..... B65D 83/202
2016/0347533 A1 * 12/2016 Giordano ..... A45D 27/10
2017/0072769 A1 * 3/2017 Quest ..... G01F 23/22
2018/0236471 A1 * 8/2018 Sulzer ..... B05B 7/0815
2019/0177074 A1 * 6/2019 Waugh ..... B65D 83/303

OTHER PUBLICATIONS

"How to Use Great Stuff™ to Air Seal You Home", 2019, Retrieved from the Internet: <www.greatstuff.dupont.com/air-sealing-how-to-videos.html>.
International Search Report dated Feb. 27, 2019 of corresponding International Patent Application No. PCT/US18/64895.

* cited by examiner

AEROSOL APPLICATOR OF EXPANDING FOAM CHEMICALS

FIELD OF THE DISCLOSURE

The present disclosure relates generally to an applicator of viscous liquids. More particularly, the disclosure relates to an applicator of expanding foam chemicals for attachment to an aerosol container.

BACKGROUND AND SUMMARY

A variety of pressurized vessels that dispense expanding foam insulation chemicals are available on the market. When sprayed, these vessels must contain pressure sufficient to overcome the viscosity of the chemical mixture as it is forced through a spray nozzle. Professional services often utilize a refillable tank to store compressed gases, such as nitrogen, to pressurize the reusable foam chemical storage vessels for this purpose, while home-use kits typically come with pre-charged chemical vessels pressurized for a single use application.

Professional and home-use spray foam systems provide a fast curing and high quality end product. However, the price to hire a professional service or purchase small home-use kits can be unreasonably high. Therefore, when a person requires only a small quantity of spray foam insulation, such as when remodeling a room or repairing their home, the user often resorts to fiberglass batten or other economical solutions which do not offer the superior insulating and vapor barrier qualities of spray foam.

Foam chemicals dispensed from aerosol containers are inexpensive and readily available in small quantities, but unlike the professional and home-use spray system vessels, common aerosol containers cannot withstand the pressure required for spraying viscous liquids such as expanding foam chemicals. Therefore, these containers often use a different pre-mixed chemical formulation that cures with exposure to moisture in the atmosphere. Unfortunately, the combination of low surface area, low tear strength, slow cure-time, and low uncured adhesive properties of this type of foam has historically limited its use to filling small voids and recesses via straws, tubes, and similar apparatuses. Thus, while foam chemicals dispensed from aerosol containers are inexpensive and readily available, the current application methods are not suited for effectively insulating large areas such as the walls and ceilings of a home.

The present disclosure describes an applicator that provides for improved spraying and dispensing of expanding foam chemicals from aerosol containers with the optional use of a flow of compressed gas. The applicator for dispensing foam from an aerosol container according to the present disclosure has a body comprising a nozzle portion, an aerosol inlet for connection to an aerosol container having a discharge valve and comprising a foamable material, and a gas inlet for connection to a source of compressed gas. The nozzle portion comprises a first outlet for dispensing the foamable material and a second outlet for dispensing the compressed gas. An internal foam channel is disposed within the body and has an entry port at the aerosol inlet and an exit port at the first outlet. An internal gas channel is disposed within the body and has an entry port at the gas inlet and an exit port at the second outlet. A trigger positioned on a forward surface of the body, when depressed, causes the discharge valve of the aerosol container to open and allow a flow of the foamable material from the aerosol container to enter the internal foam channel.

BRIEF DESCRIPTION OF THE DRAWINGS

Further features and advantages can be ascertained from the following detailed description that is provided in connection with the drawings described below.

DETAILED DESCRIPTION

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Spatially relative terms, such as "under," "below," "lower," "over," "upper," and the like, may be used herein for ease of description to describe one element or feature's relationship to another when the apparatus is right side up as shown in the accompanying drawings.

The present disclosure provides a manually operated applicator for use with common aerosol containers that dispenses foam onto a variety of surfaces. The applicator described herein is able to dispense a powerful foam stream to quickly fill large voids in walls and other surfaces. The applicator described herein may also be connected to a compressed gas source to improve the dispersion of the expanding foams. For instance, compressed gas may be directed against the foam chemical as it exits the applicator to fragment the foam into a fine spray and evenly spray the foam onto surfaces. The resulting high fragment velocity, in addition to the improved surface-to-weight ratio of the smaller foam particles, allows the user of the applicator to uniformly coat surfaces with excellent adhesion. Moreover, the described applicator may utilize an extender tube or straw attachment to precisely apply beads of foam into small holes, recesses, and crevices.

Figure 1:
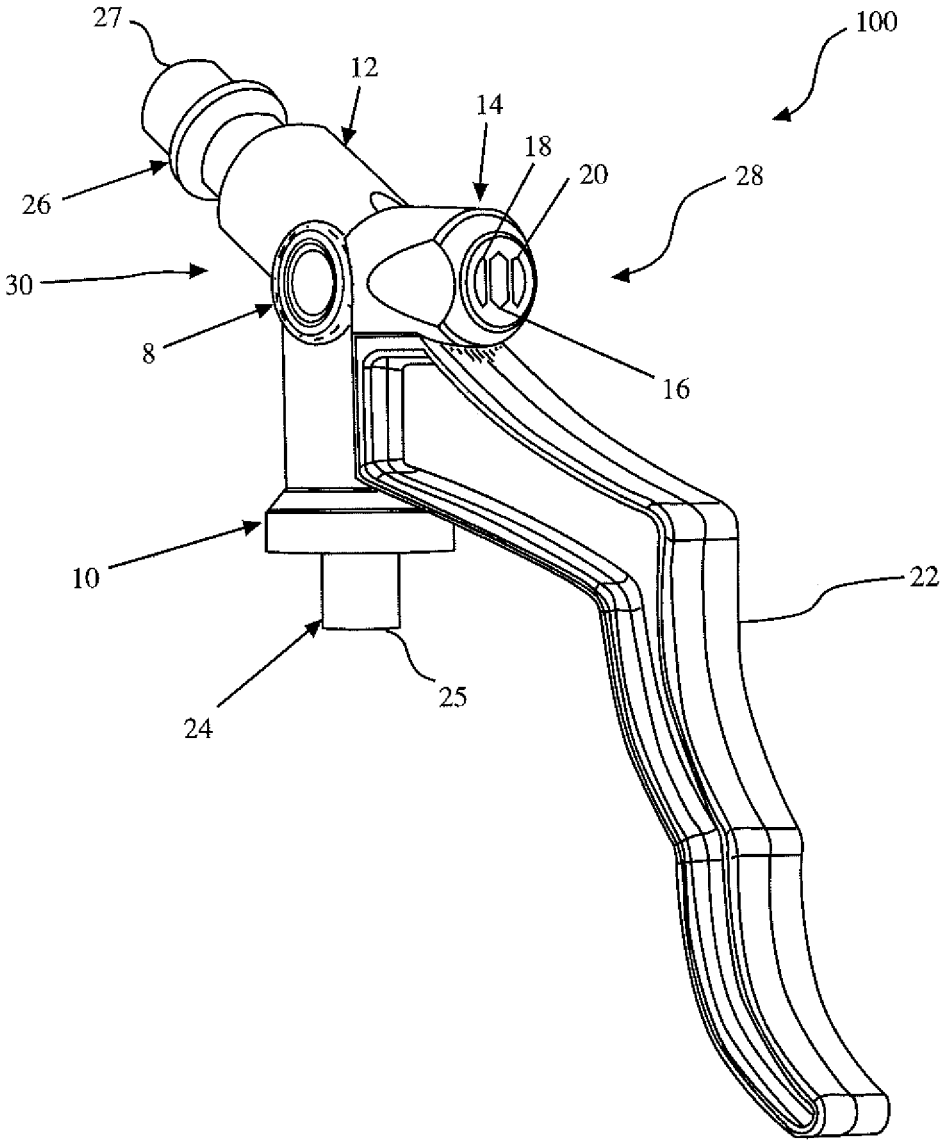
FIG. 1 is a front perspective view of an aerosol applicator in accordance with an exemplary embodiment of the present disclosure.

FIG. 1 is a front perspective view of an aerosol applicator 100 according to an exemplary embodiment of the present disclosure. The aerosol applicator 100 comprises a body 8. The body 8 comprises a nozzle 14 positioned at a forward end 28, an aerosol connector 10 positioned below the nozzle 14, and a gas connector 12 positioned at a rearward end 30. The nozzle 14 has a foam outlet 16 that is in fluid communication with an interior channel (not shown) extending to the aerosol connector 10. The nozzle also has gas outlets 18 and 20 that are in fluid communication with channels (not shown) extending to the gas connector 12. The aerosol applicator 100 is manually-operated by a trigger 22 that is mounted on the body 8 directly below the nozzle 14 and adjacent to the aerosol connector 10.

The aerosol applicator 100 may be formed from any material and process suitable to produce a product of substantial strength to perform the functions as described herein. In one embodiment, the aerosol applicator 100 is formed from a plastic material that is durable, chemical resistant, and allows for the aerosol applicator 100 to be cleaned with acetone to remove residual uncured foam between uses. For example, the aerosol applicator 100 may be formed from nylon, various polyethylenes (such as high density polyethylene (HDPE), low density polyethylene (LDPE), and linear low density polyethylene (LLDPE)), polyvinyl chloride, polypropylene, ABS, biopolymers, and polystyrene. The aerosol applicator 100 may be constructed according to various manufacturing methods including injection molding, milling, forging, extrusion, pressing, and other related manufacturing methods.

In one embodiment, as shown in FIG. 1, the nozzle 14, the aerosol connector 10, the gas connector 12, and the trigger 22 are integrally molded with the body 8 to form the aerosol applicator 100 as a single piece of material. In this aspect, the aerosol application 100 may be constructed using injection molding. In another embodiment, each of the parts described above may be formed as separate pieces of material and may be attached to the body 8 of the aerosol applicator 100 by any suitable means including, but not limited to, threaded coupling, screws, pins, projections, tongue and groove solutions, or snap catch elements. This allows for a user to more easily interchange broken or unusable parts and provides for easier cleaning.

The aerosol connector 10 is used to connect a foam dispensing aerosol container (not shown) to the aerosol applicator 100. In this aspect, the aerosol connector 10 serves as an inlet for a foam stream from the aerosol container. The foam dispensing aerosol container may comprise any conventional aerosol can containing a foamable material, for example, a pre-mixed expanding foam chemical. The foam dispensing aerosol container should be capable of releasing the foamable material through a discharge valve (not shown) at the top of the foam dispensing aerosol container. The aerosol connector 10 may comprise an adapter 24 for attaching a variety of foam dispensing aerosol containers (not shown) to the aerosol applicator 100. The adapter 24 is a tubular component which, at a lower end 25, is formed internally with a connection means for attachment to the foam dispensing aerosol container. For example, the adapter 24 may include internal threading so that the foam dispensing aerosol container may be attached to the adapter 24 via threaded coupling. However, as will be apparent to one of ordinary skill in the art, the design and configuration of the aerosol connector 10 and adapter 24 may be modified to connect to a variety of different aerosol containers used to dispense viscous foam chemicals. In another embodiment, the discharge valve housed on top of the aerosol container may be incorporated within the aerosol connector 10 and affixed to the aerosol container as a single unit.

The trigger 22 controls the flow of the foam stream from the foam dispensing aerosol container that is attached at the aerosol connector 10. The trigger 22 is positioned below the nozzle 14 and adjacent to the aerosol connector 10. The trigger 22 is arranged for actuation by a finger or fingers of a user holding the aerosol applicator 100. Upon actuation of the trigger 22, the trigger 22 applies pressure onto the aerosol connector 10 and readily forces the discharge valve (not shown) of the foam dispensing aerosol container to an angle sufficient to open the discharge valve and allow the foam stream to flow from the foam dispensing aerosol container to a foam channel (not shown) within the aerosol applicator 100. That is, upon actuation of the trigger 22, the trigger 22 torques the discharge valve, which results in the opening of a fluid pathway of foam into the aerosol applicator 100. When the trigger 22 is released, the flow of foam into the aerosol applicator 100 stops.

Due to the proximity of the trigger 22 to the nozzle 14, the length of the trigger 22 should extend sufficiently far enough away from the nozzle 14 so that the foam and compressed gas exiting the nozzle 14 does not contact the user's hand or fingers when placed on the trigger 22. For example, in one embodiment, the length of the trigger 22 should be at least 2 inches. The length of the trigger 22 is the vertical distance from the nozzle 14. In another embodiment, the length of the trigger 22 should be at least 3 inches.

The shape of the trigger 22 may vary so long as the shape allows for the trigger 22 to be sufficiently strong and sturdy enough to open the discharge valve of the foam dispensing aerosol container upon actuation. In the illustrated embodiment, the trigger 22 comprises an elongated handle-like structure having at least two curved scallop shapes for grasping by the user's fingers. In another embodiment, the trigger 22 may incorporate one or more loops on the handle-like structure so that the user may interlock their fingers within the one or more loops for a more secure grip.

The gas connector 12 is used to connect a compressed gas source (not shown) to the aerosol applicator 100. In this aspect, the gas connector 12 serves as an inlet for compressed or pressurized gas from the compressed gas source. The compressed gas helps to improve the adhesiveness of the foam by fragmenting the foam as it exits the aerosol applicator 100. The use of compressed gas is advantageous when applying the foam to vertical and overhead surfaces.

In one embodiment, the air from the compressed gas source is unfiltered. Typically, unfiltered compressed air is not used when applying foam because it may contain water which can hinder the curing process of multi-resin spray systems. However, with the use of the foam dispensing aerosol containers described herein, it is actually advantageous that the foam react with water in the atmosphere to cure. As such, the water present in the unfiltered compressed air used in accordance with the present disclosure will not significantly hinder the physical properties of the cured foam.

In the illustrated embodiment, the gas connector 12 comprises a standard male pneumatic quick connect coupling 26 for securely connecting the compressed gas source to the aerosol applicator 100. The pneumatic quick connect coupling 26 has a tubular end 27 for receiving a connection end of the compressed gas source via a standard female pneumatic quick connect coupling. In an alternative embodiment, the tubular end 27 may be a male or female component having threading for connecting to compatible compressed gas sources. For example, the compressed gas may be transferred through an air line, pipe, or hose that can attach to the tubular end 27 via threaded coupling. While the gas connector 12 has been illustrated herein as a pneumatic quick connect coupling, one of ordinary skill in the art will understand that the compressed gas source may be secured to the gas connector 12 by any other suitable means including, but not limited to, threaded compression coupling, clamps, screws, pins, or projections.

The flow of the compressed gas from the compressed gas source may be controlled by disconnecting the compressed gas source from the aerosol applicator 100. In another embodiment, the flow of the compressed gas may be controlled by a valve on the air line, pipe, or hose. For instance, the valve on the air line, pipe, or hose may operate between an open and closed position to control the flow of compressed gas from the compressed gas source. In still another embodiment, the trigger 22 may be designed to pivot from a position adjacent to the aerosol connector 10 to a position adjacent to the gas connector 12 so as to actuate the flow of both the foam from the aerosol connector 10 and the compressed gas from the gas connector 12.

In some embodiments, a compressed gas source may not be connected to the gas connector 12. That is, in some embodiments, the compressed gas may not be necessary as the design of the applicator 100 allows for a forceful ejection of foam chemical suitable to fill wall cavities and the like.

The foam stream from the foam dispensing aerosol container and the compressed gas from the compressed gas source exit the aerosol applicator 100 through the nozzle 14. The nozzle 14 comprises at least one foam outlet 16 where the foam stream exits the aerosol applicator 100. The foam outlet 16 may be positioned in the center of the nozzle as shown in FIG. 1. The nozzle 14 also comprises at least one gas outlet 18 where the compressed gas exits the aerosol applicator 100. In the illustrated embodiment (FIG. 1), the nozzle 14 has one central foam outlet 16 and two gas outlets 18 and 20, one positioned on each side of the central foam outlet 16. The one or more gas outlets 18 and 20 should be placed in close proximity to the foam outlet 16 so that the compressed gas is able to contact and fragment the foam as the materials exit the nozzle 14. In one embodiment, the distance between the one or more gas outlets 18 and 20 and the foam outlet 16 is about 0.03 inches or less. In another embodiment, the distance between the one or more gas outlets 18 and 20 and the foam outlet 16 is about 0.02 inches or less. In still another embodiment, the distance between the one or more gas outlets 18 and 20 and the foam outlet 16 is about 0.01 inches or less. In another embodiment, the distance between the one or more gas outlets 18 and 20 and the foam outlet 16 is about 0.0075 inches or less. In still another embodiment, the distance between the one or more gas outlets 18 and 20 and the foam outlet 16 is about 0.005 inches or less. As the compressed gas exits the gas outlets 18 and 20, the compressed gas expands forcefully against, and fragments, the foam stream, which allows for better adhesion of the foam to surfaces, such as vertical and overhead surfaces.

Figure 2:
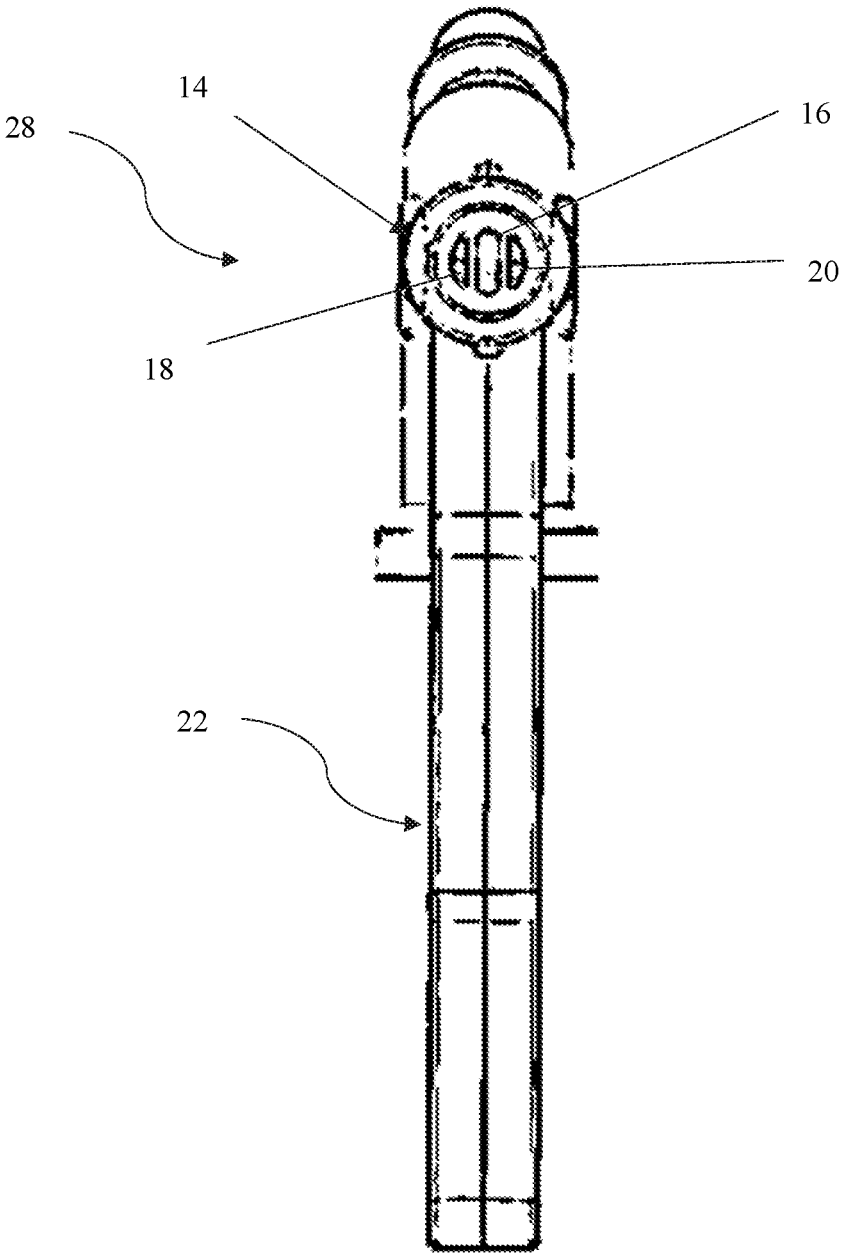
FIG. 2 is a front view of the aerosol applicator of FIG. 1.

FIG. 2 is a front view of the aerosol applicator 100 of FIG. 1. As shown in FIG. 2, the foam outlet 16 and the gas outlets 18 and 20 are generally shaped as vertically oriented slots. Each of the vertically oriented slots may have one or more curved outer edges to match the circular shape of the nozzle 14. However, as will be apparent to those skilled in the art, the foam outlet 16 and the gas outlets 18 and 20 may take on any shape sufficient to allow the compressed gas and foam to exit the nozzle 14 and to allow for the compressed gas to fragment the foam exiting the nozzle 14. For instance, the foam outlet 16 and the gas outlets 18 and 20 may be vertically or horizontally oriented slots or slits or as round holes. The shape of the foam outlet 16 and the gas outlets 18 and 20 may also vary. For example, the foam outlet 16 and the gas outlets 18 and 20 may be rectangular, circular, or square.

Figure 3:
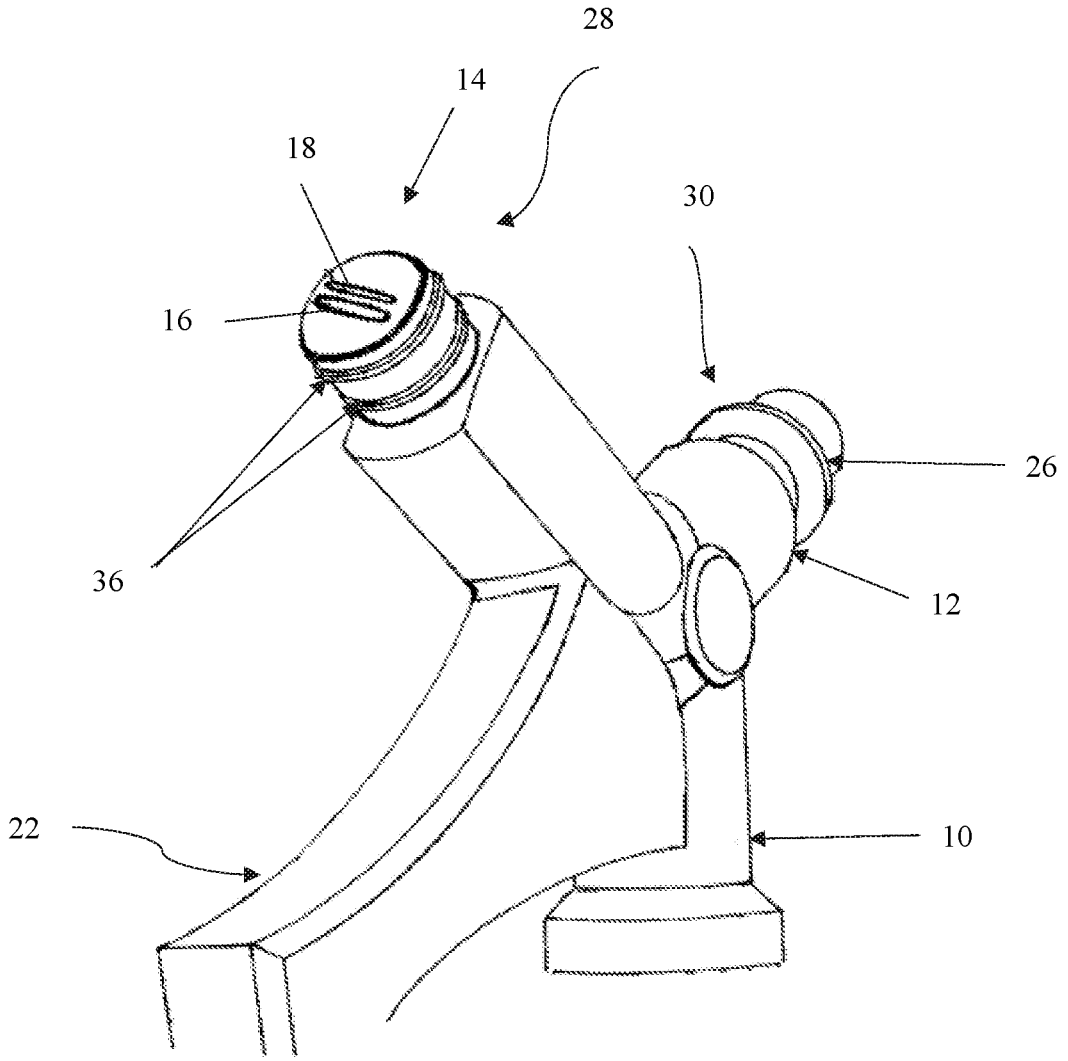
FIG. 3 is a partial front perspective view of an aerosol applicator in accordance with another embodiment of the present disclosure.

FIG. 3 is a partial front perspective view of another embodiment of the aerosol applicator 100 where the nozzle 14 has one foam outlet 16 and one gas outlet 18. As shown in FIG. 3, the nozzle 14 has a single gas outlet 18 positioned above the central foam outlet 16. The use of a single gas outlet 18 and a single foam outlet 16 can be advantageous in that it simplifies the design of the aerosol applicator 100 for ease of manufacturing. However, any number of foam outlets 16 or gas outlets 18 may be used on the nozzle 14. In the illustrated embodiment (FIG. 3), the foam outlet 16 and the gas outlet 18 are shaped as horizontally oriented slots where the gas outlet 18 is positioned above and in close proximity to the foam outlet 16. The positioning of the gas outlet 18 above the foam outlet 16 provides for the compressed gas to expand and push the foam in a downward direction. With the use of horizontally oriented slots as outlets, the compressed gas exiting the gas outlet 18 can direct the foam exiting the foam outlet 16 to a calculated angle. This is advantageous for providing foam to areas or crevices that may be hard to reach. Moreover, as shown in FIG. 3, the width of the gas outlet 18 is less than the width of the foam outlet 16, which helps to increase the air velocity.

In some embodiments, the nozzle 14 is configured to accept an extender tube, for example, a straw attachment (not shown), when compressed gas is not utilized with the aerosol applicator 100. The straw attachment allows the user to have greater control in directing the foam toward surfaces. For instance, the straw attachment allows a user to more precisely apply the foam in small holes, recesses, and crevices. The straw attachment may have any desired length and should have a diameter effective to limit expansion of the foam until it is discharged from the end of the tube.

The straw attachment may be attached to the nozzle 14 using any suitable means that prevents the foam from escaping out of the end of the straw attachment where it attaches to the nozzle 14. In the illustrated embodiment, as shown in FIG. 3, the outer surface of the nozzle 14 comprises a plurality of raised rings 36 for attaching the straw attachment. The raised rings 36 serve to pressure fit the straw attachment. As the straw attachment is attached to the outer surface of the nozzle 14, the raised rings 36 apply pressure to and seal the inner diameter of the straw attachment to the nozzle 14. In another embodiment, the straw attachment may be attached to the nozzle 14 via O-ring seals, threads or barbs.

Figure 4:
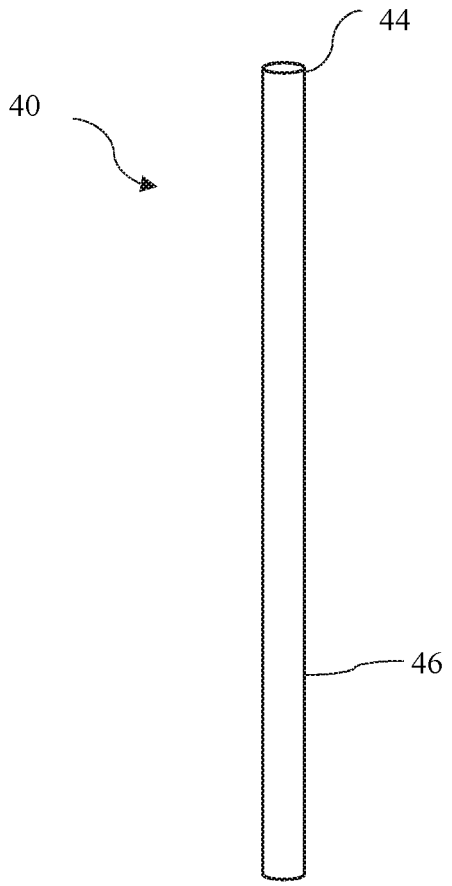
FIG. 4 is a front perspective view of a straw attachment.

FIG. 4 is a front perspective view of a straw attachment 40 in accordance with an exemplary embodiment of the present disclosure. The straw attachment 40 has an elongated hollow body 46 that can serve as a channel for the foam stream. The straw attachment 40 can be matingly engaged with the nozzle 14 on the proximal end 44 of the straw attachment 40.

Figure 5:
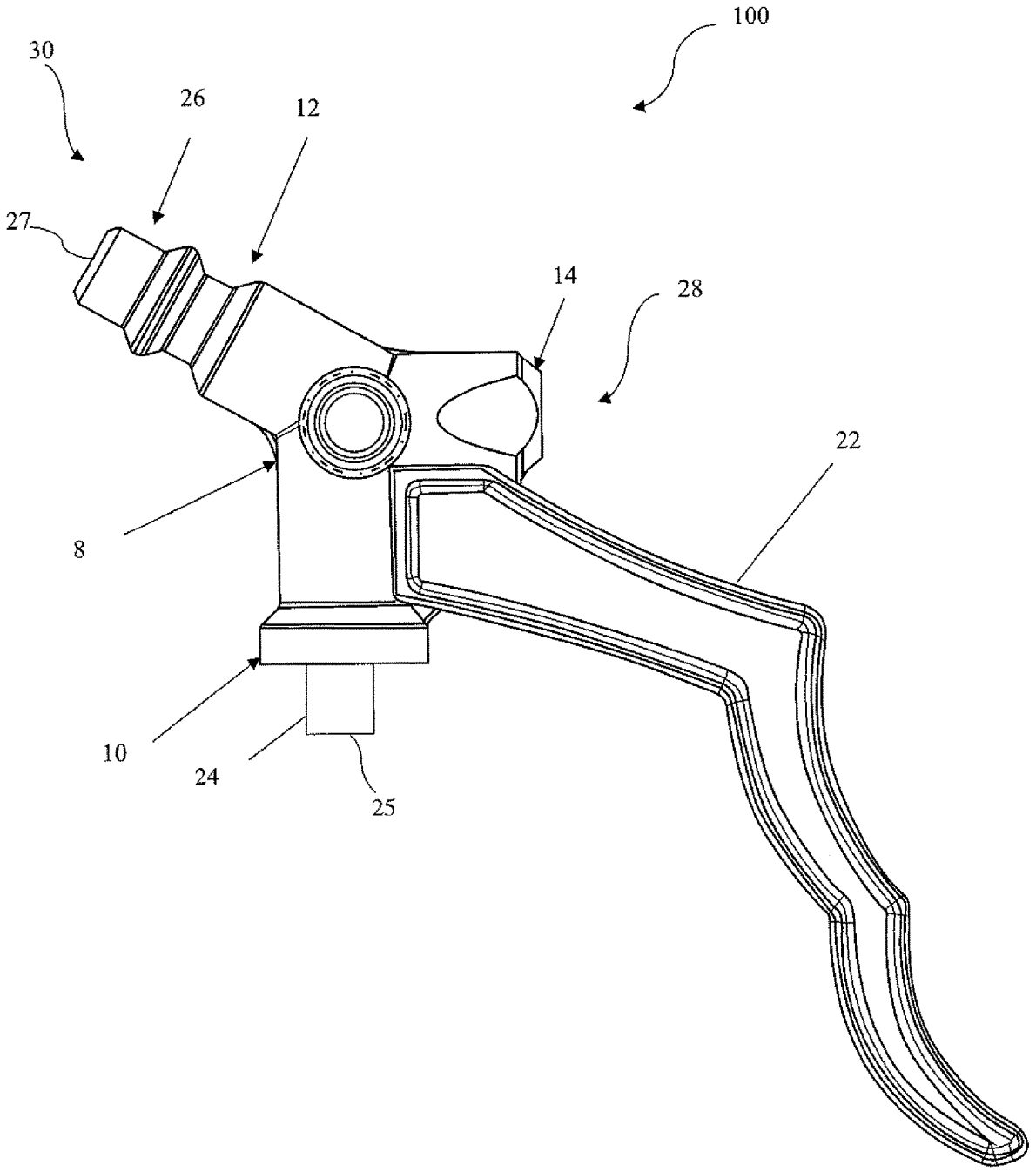
FIG. 5 is a side view of the aerosol applicator of FIG. 1.

FIG. 5 is a side view of the aerosol applicator 100 showing the arrangement of the nozzle 14, the gas connector 12, and the aerosol connector 10 on the body 8 of the aerosol applicator 100. In the illustrated embodiment, the nozzle 14 forms an angle of about 90 degrees with the longitudinal or vertical axis of the body 8. The aerosol connector 10 is positioned below the nozzle 14 in a substantially vertical orientation and along the longitudinal axis of the body 8 such that the aerosol connector 10 forms an angle of about 90 degrees with the nozzle 14. This arrangement allows for the attached foam dispensing aerosol container (not shown) to be slightly inverted when spraying the foam on overhead surfaces, such as ceilings. In another embodiment, the aerosol connector 10 may form an angle greater than or less than 90 degrees with the nozzle 14. For example, the aerosol connector 10 and the nozzle 14 may form an angle of about 60 degrees to about 180 degrees. In still another embodiment, the aerosol connector 10 and the nozzle 14 may form an angle of about 70 degrees to about 150 degrees. In yet another embodiment, the aerosol connector 10 and the nozzle 14 may form an angle of about 80 degrees to about 120 degrees. In still another embodiment, the aerosol connector 10 and the nozzle 14 may form an angle of about 85 degrees to about 110 degrees.

The gas connector 12 is positioned behind the nozzle 14 such that the gas connector 12 and the nozzle 14 form an angle that is greater than 90 degrees with respect to the longitudinal axis of the body 8. The angle should allow for the air line or hose of the compressed gas source to hang at a downward angle when spraying vertical walls or overhead ceilings. For example, the gas connector 12 and the nozzle 14 may form an angle of about 100 degrees to about 240 degrees. In another embodiment, the gas connector 12 and the nozzle 14 may form an angle of about 100 degrees to about 215 degrees. In still another embodiment, the gas connector 12 and the nozzle 14 may form an angle of about 110 degrees to about 200 degrees. In yet another embodiment, the gas connector 12 and the nozzle 14 may form an angle of about 115 degrees to about 180 degrees.

Figure 6:
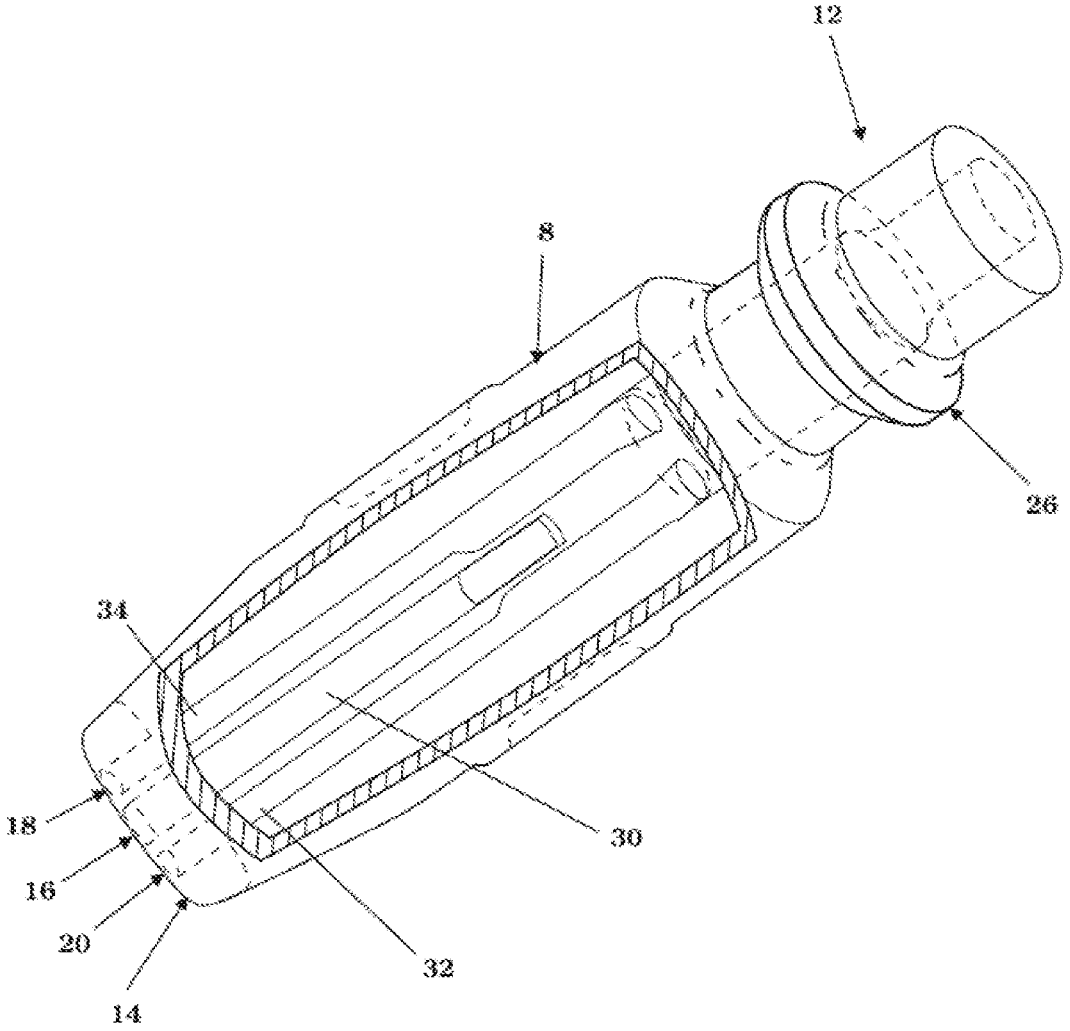
FIG. 6 is a top interior view of the aerosol applicator of FIG. 1.

FIG. 6 is a top partially-interior view of the aerosol applicator 100. FIG. 6 shows the channels through which the foam stream and the compressed gas are transferred through the body 8 before exiting the nozzle 14. As shown in the illustrated embodiment, the interior of body 8 comprises a foam channel 30 that extends from the aerosol connector (not shown) to the foam outlet 16. The foam channel 30 is operatively connected to the foam dispensing aerosol container at the aerosol connector 10 such that, when the trigger 22 (FIG. 1) is actuated, the discharge valve at the top of the foam dispensing aerosol container is opened and foam flows from the aerosol container through the foam channel 30 to the foam outlet 16 where the foam exits the aerosol applicator 100. In the illustrated embodiment, a single foam channel 30 having a single foam outlet 16 is shown. However, in the event that more than one foam outlet is utilized on the nozzle, one of ordinary skill in the art will understand that additional foam channels may be needed to transport the foam to the additional foam outlets.

As shown in FIG. 6, the interior of body 8 also comprises two gas channels 32 and 34 that transfer the compressed gas from the compressed gas source (not shown) attached at the gas connector 12 to the nozzle 14. The gas channels 32 and 34 extend substantially through the body 8 from the gas connector 12 to the gas outlets 18 and 20. The gas channels 32 and 34 are operatively connected to the compressed gas source (not shown) at the gas connector 12 such that, when the flow of compressed gas begins, the compressed gas travels through the gas channels 32 and 34 and to the respective gas outlets 18 and 20. In the illustrated embodiment, the gas channels 32 and 34 extend from the respective gas outlets 18 and 20 through the body 8 as separate channels positioned on each side of the foam channel 30. As the gas channels 32 and 34 approach the gas connector 12, the gas channels 32 and 34 converge into a single channel that attaches to the compressed gas source. Having the gas channels 32 and 34 converge at the gas connector 12 to form a single channel can dispense of the need for more than one compressed gas source. However, as will be apparent to one of ordinary skill in the art, the gas connector 12 may be designed to include more than one connection port (for example, more than one pneumatic quick connect) for multiple compressed gas sources to accommodate gas channels that do not converge at the gas connector 12.

In the illustrated embodiment, the foam channel 30 and the gas channels 32 and 34 are substantially separated within the body 8. That is, the foam channel 30 does not intersect with the gas channels 32, 34. This prevents the foam from exiting or escaping from the gas connector 12 when the applicator 100 is utilized without compressed gas.

In another embodiment, the foam channel 30 and the gas channels 32 and 34 may intersect such that the foam stream and the compressed gas are mixed internally within the body 8. For example, the foam channel 30 and the gas channels 32 and 34 may be designed to intersect as they enter the nozzle 14 which increases the pressure and velocity of the released foam chemical. However, when the foam channel 30 and the gas channels 32 and 34 intersect internally and compressed gas is not being used during the operation of the aerosol applicator 100, a stopping or plugging mechanism should be employed in the gas connector 12 to restrict the foam stream from exiting the gas connector 12.

In still another embodiment, the foam channel 30 and the gas channels 32 and 34 may be designed as channels of differing diameter where a smaller channel, for example, the foam channel, is held substantially within the center of the larger channel, for example, the gas channel. The smaller (inner) channel may be operatively connected to the foam dispensing aerosol container at the aerosol connector 10, while the larger (outer) channel may be operatively connected to the compressed gas source at the gas connector 12. The foam stream can be transferred through the smaller (inner) channel and the compressed gas can be transferred through the larger (outer) channel. In this configuration, because the compressed air fully encircles the foam chemical as it exits the inner channel, the foam can be sprayed evenly and demonstrates good adhesion.

While the foam channel 30 and the gas channels 32 and 34 are depicted as circular, any geometric shape for the channels is an option, including rectangular and square. The foam channel 30 and the gas channels 32 and 34 may be composed of any type of material that allows for the transfer of a foam stream and compressed gas. In one embodiment, the foam channel 30 and the gas channels 32 and 34 may be composed of injection molded plastic. In another embodiment, the foam channel 30 and the gas channels 32 and 34 may be composed of tubing. For instance, the foam channel 30 and gas channels 32 and 34 may be any type of plastic tubing, such as tubing formed from ethyl vinyl acetate (EVA), polytetrafluoroethylene (PTFE), polyvinylidene fluoride (PVDF), polyethylene (PE), polypropylene (PP), polyurethane (PU), and poly-vinyl chloride (PVC).

Figure 7:
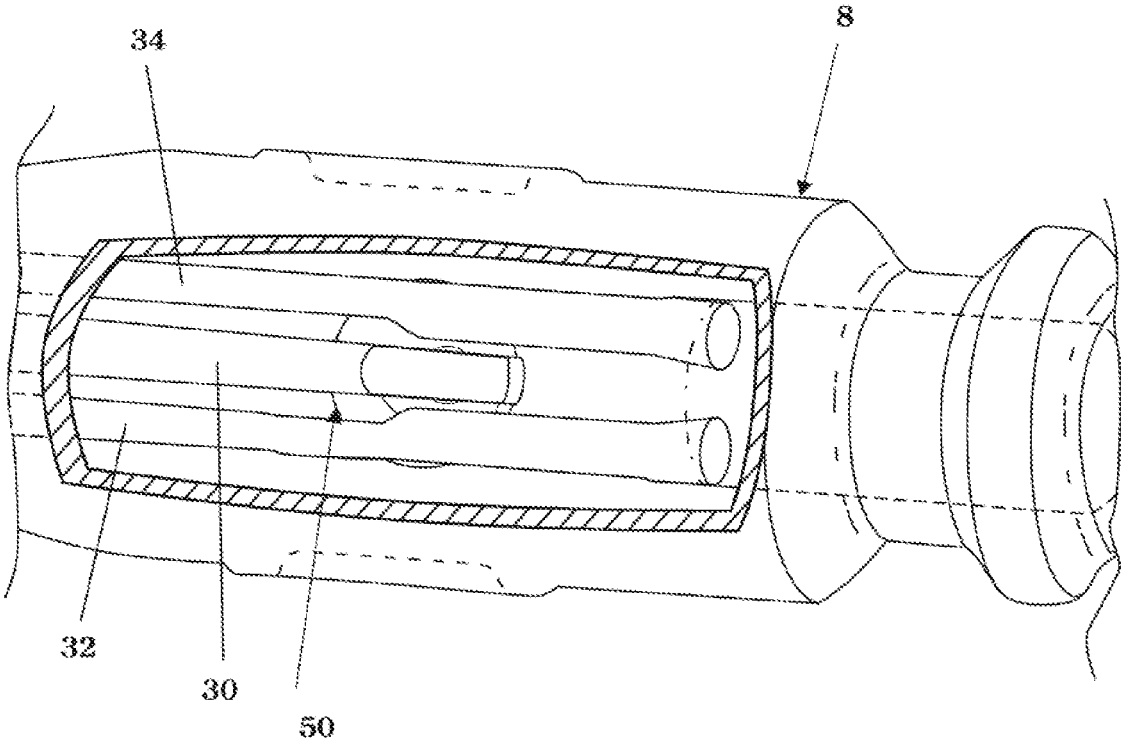
FIG. 7 is a partial top interior view of the aerosol applicator of FIG. 1.

FIG. 7 is a partial top interior view of the aerosol applicator 100 of FIG. 6. FIG. 7 illustrates the internal mechanism utilized to control the flow of the foam and compressed gas through the foam channel 30 and the gas channels 32 and 34, respectively. Aerosol connection point 50 is a circular threaded connection point for attaching the foam dispensing aerosol container (not shown) to the foam channel 30. The aerosol connection point 50 is positioned between the gas channels 32 and 34. In this aspect, the diameter of the aerosol connection point 50 is reduced down to fit between the gas channels 32 and 34 without intersecting the gas channels 32 and 34. The aerosol connection point 50 directs the flow of the foam from the foam dispensing aerosol container into the foam channel 30.

Figure 8:
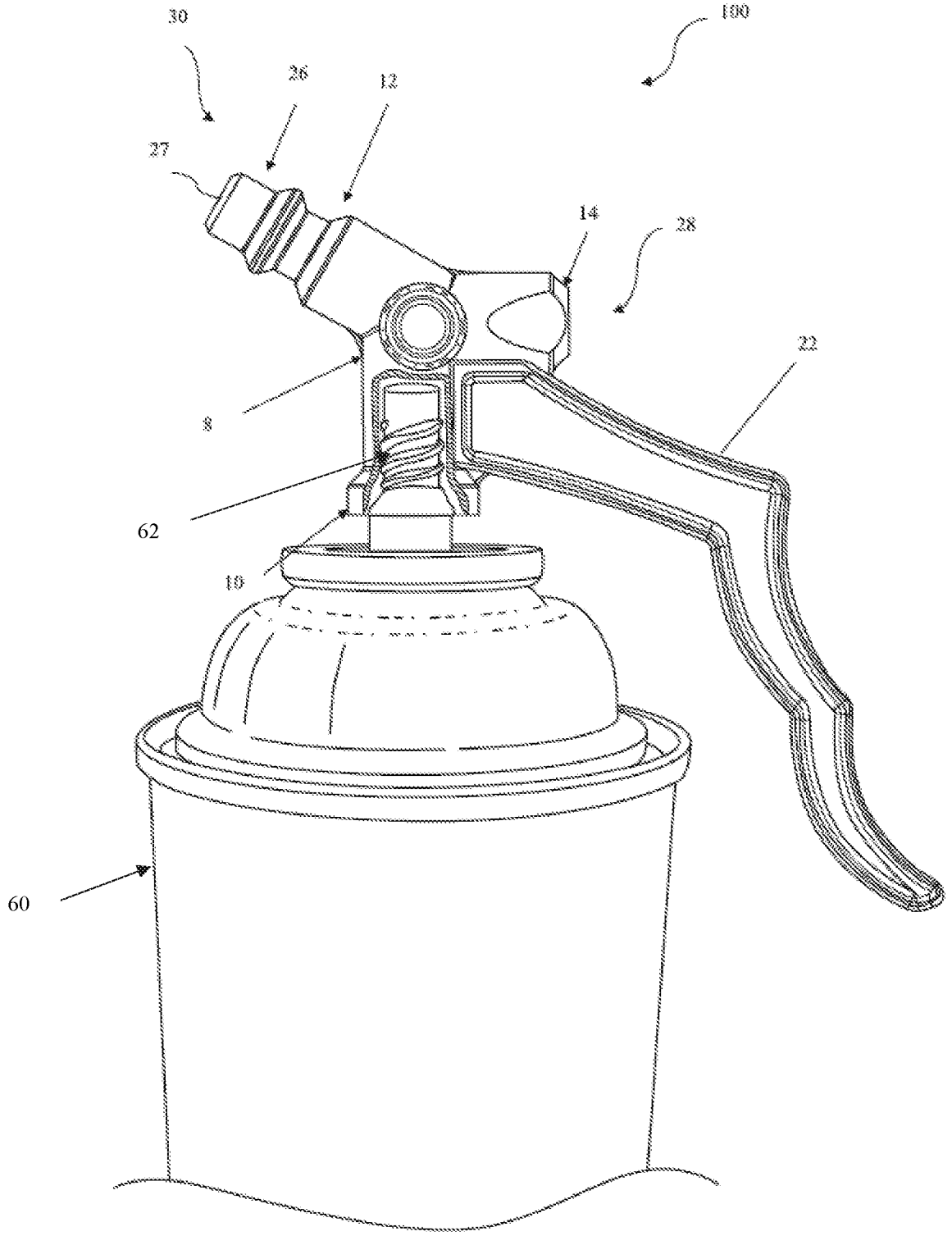
FIG. 8 is a side view of the aerosol applicator of FIG. 1 with a foam dispensing aerosol container attached thereto.

FIG. 8 is a side view of the aerosol applicator 100 of FIG. 1 with a foam dispensing aerosol container 60 attached thereto. The foam dispensing aerosol container 60 is attached to the applicator 100 at the aerosol connector 10. As shown in FIG. 8, the foam dispensing aerosol container 60 has a discharge valve 62 that is positioned within the applicator 100. The aerosol connector 10 operatively engages the discharge valve 62 of the foam dispensing aerosol container 60 such that, upon actuation of the trigger 22, the trigger 22 applies pressure onto the aerosol connector 10 and readily forces the discharge valve 62 to an angle sufficient to open the discharge valve 62. This allows the foam stream to flow from the foam dispensing aerosol container 60 to a foam channel (not shown) within the aerosol applicator 100.

The device described and claimed herein is not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. An applicator for dispensing foam from an aerosol container, comprising:

a body comprising a nozzle portion, an aerosol inlet for connection to an aerosol container having a discharge valve and comprising a foamable material, and a gas inlet for connection to a source of compressed gas, the gas inlet comprising a pneumatic quick connect coupling device for attachment to the source of compressed gas, wherein the nozzle portion comprises a foam outlet for dispensing the foamable material and a first gas outlet and a second gas outlet for dispensing compressed gas, the first gas outlet and the second gas outlet positioned adjacent to the foam outlet and the foam outlet positioned in between the first gas outlet and the second gas outlet, and wherein the aerosol inlet operatively engages the discharge valve of the aerosol container;

a foam channel disposed within the body and having an entry port at the aerosol inlet and an exit port at the foam outlet;

a first gas channel disposed within the body, the first gas channel having an entry port at the gas inlet and an exit port at the first gas outlet;

a second gas channel disposed within the body, the second gas channel having an entry port at the gas inlet and an exit port at the second gas outlet;

a trigger positioned on a forward surface of the body and adjacent to the aerosol inlet, where upon depression of the trigger, the discharge valve of the aerosol container is configured to open and allow the foamable material from the aerosol container to flow into the foam channel at the entry port.

2. The applicator of claim 1, wherein the foam channel does not intersect with the first gas channel and the second gas channel.

3. The applicator of claim 1, wherein the nozzle portion is positioned on the body at an angle of about 90 degrees with respect to a longitudinal axis of the body.

4. The applicator of claim 3, wherein the aerosol inlet is positioned below the nozzle portion and is configured to form an angle of about 60 degrees to about 180 degrees with the nozzle portion.

5. The applicator of claim 4, wherein the aerosol inlet is positioned below the nozzle portion and is configured to form an angle of about 90 degrees with the nozzle portion.

6. The applicator of claim 1, wherein the trigger is at least two inches in length.

7. The applicator of claim 1, wherein the first gas channel and the second gas channel share the same entry port at the gas inlet.

8. The applicator of claim 7, wherein upon depression of the trigger, the compressed gas is configured to flow into the first gas channel and the second gas channel at the entry port at the gas inlet.

* * * * *